US006250581B1

(12) United States Patent
Cramer

(10) Patent No.: US 6,250,581 B1
(45) Date of Patent: Jun. 26, 2001

(54) WEB WINDING DEVICE AND METHOD

(75) Inventor: Dirk Cramer, Duisburg (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/231,814

(22) Filed: Jan. 15, 1999

(30) Foreign Application Priority Data

Jan. 17, 1998 (DE) ..... 198 01 599

(51) Int. Cl.[7] ..... B65H 18/14

(52) U.S. Cl. ..... 242/541.7; 242/542.4; 242/542; 242/541.6; 226/95; 226/97.1; 226/97.3

(58) Field of Search ..... 242/542.4, 541.7, 242/541.6, 542; 226/95, 97.1, 97.3

(56) References Cited

U.S. PATENT DOCUMENTS

| | | | | |
|---|---|---|---|---|
| 3,117,499 | * | 1/1964 | Golding | 242/95 X |
| 3,549,098 | * | 12/1970 | Helkala et al. | 242/542.4 |
| 3,869,095 | * | 3/1975 | Diltz | 242/531 |
| 4,327,877 | * | 5/1982 | Perini | 242/542 X |
| 5,092,533 | * | 3/1992 | Gangemi | 242/521 |
| 5,222,679 | * | 6/1993 | Dropczynski et al. | 242/521 |
| 5,358,163 | | 10/1994 | Naka . | |
| 5,518,199 | * | 5/1996 | Welp et al. | 242/530.4 |
| 5,758,842 | * | 6/1998 | Dorfel et al. | 242/542 |
| 5,820,063 | * | 10/1998 | Fissman et al. | 242/530.4 |
| 5,823,463 | | 10/1998 | Fissmann et al. . | |
| 5,845,866 | * | 12/1998 | Kaipf | 242/521 |
| 5,928,124 | * | 7/1999 | Gheradi et al. | 493/459 |
| 6,056,230 | * | 5/2000 | Peters et al. | 242/541.5 |

FOREIGN PATENT DOCUMENTS

| | | | |
|---|---|---|---|
| 691282 | | 5/1940 | (DE) . |
| 8717259 | | 7/1988 | (DE) . |
| 4409036 | * | 9/1995 | (DE) . |
| 0791550 | | 8/1997 | (EP) . |
| 854936 | * | 11/1960 | (GB) . |
| 2226304 | | 6/1990 | (GB) . |

* cited by examiner

*Primary Examiner*—Donald P. Walsh
*Assistant Examiner*—Minh-Chau Pham
(74) *Attorney, Agent, or Firm*—Greenblum & Bernstein, P.L.C.

(57) ABSTRACT

Web winding device for winding a material web into a winding roll. The device comprises a rotatably driven first support roller having a circumferential shell and opposed ends, the shell having an outer surface, an inner surface and further having a plurality of shell openings therethrough. A second support roller is also provided. An end face is disposed at one of the opposed ends of the first support roller and a plurality of conduits are axially disposed within the first support roller and axially extend to the end face section, at least one of the plurality of shell openings communicating with each the conduit. A winding bed area is defined by the first and the second support roller, and adapted to support the winding roll. A suction device is mounted to the end face and provides suction to a portion of the surface of the shell. The suction device is fixed relative to the rotation of said first support roller. A pressurization device may also be used to pressurize the winding bed area. The conduits are in sequential communication with the suction device as the roller rotates. A method of winding a material web into a winding roll is also provided.

28 Claims, 1 Drawing Sheet

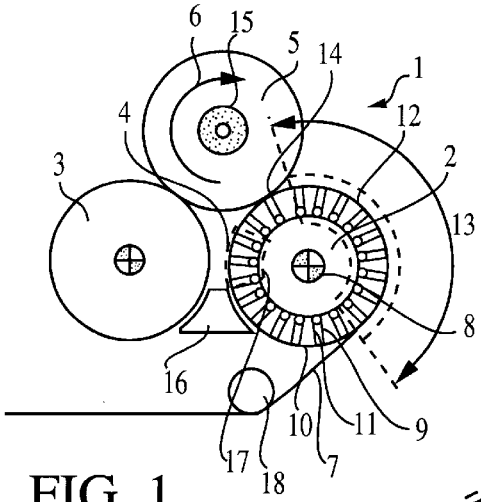
FIG. 1
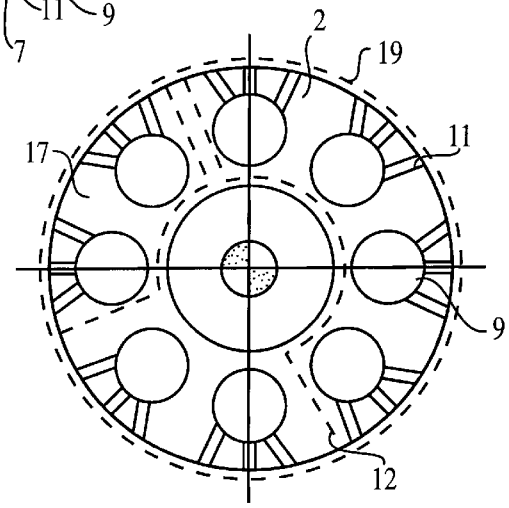
FIG. 2
FIG. 3
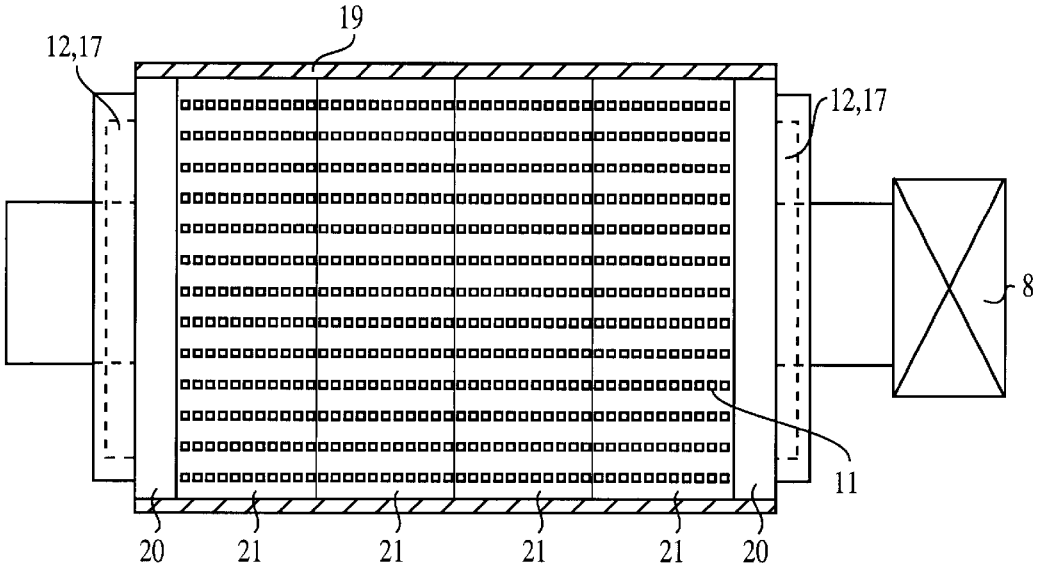

WEB WINDING DEVICE AND METHOD

CROSS-REFERENCE TO RELATED APPLICATIONS

The present application claims priority under 35 U.S.C. § 119 of German Patent Application No. 198 01 599.2, filed on Jan. 17, 1998, the disclosure of which is expressly incorporated by reference herein in its entirety.

BACKGROUND OF THE INVENTION

1. Field of the Invention

The invention relates to a web winding device and method, and more particularly, to a web winding device and method for winding a material web into a winding roll, with a winding bed that is defined by at least one driven first support roller and a second support roller.

2. Discussion of Background Information

In one of the last manufacturing steps before paper leaves the paper factory, the paper web must be rolled into a winding roll so that it can be transported and above all, can be handled by a user.

A simple winding device of this type is the so-called support roller winder. Here, the winding roll rests on two (or more) support rollers. When one support roller is driveably rotated, the support roller simultaneously drives the winding roll along the circumference of the winding roll. Through rotation of the winding roll, the material web is drawn onto the winding roll. Although the diameter of the winding roll is increased in this process, this increase is not problematic since the center or the roll core of the winding roll can be moved from the support rollers.

A web winding device of the type mentioned above is known from DE 87 17 259 U1. With a winding device of this type, there exists the risk that air will get trapped between the layers of the winding roll. To prevent this, in one embodiment, the surfaces of the first support roller are provided with an elastic cover. In another embodiment, the winding device is embodied not as a double web winder, but as a support drum roller. In this embodiment, the jacket of the carrying drum can have a perforation through which air between the incoming web and the carrying drum can be removed to prevent the web from lifting away from the drum.

Another web winding device is disclosed in EP 0 791 550 A2. In this device, one of the two support rollers is provided with a vacuum box, which is effective on a portion of the circumference of this support roller that is outside the winding bed. If the roll is changed, the beginning of the incoming material web must be secured and the vacuum must be switched on. The material web can then be transported to the winding bed with the aid of the vacuum. During winding, the vacuum is switched off and pressure is built up in the winding bed. This pressure urges the roll upward, thereby reducing the load of the roll on the support rollers.

In a winding roll, the proper progression of winding tightness is of great significance. Normally, a greater winding tightness is needed on the inside of the winding roll than in the outer layers. The winding tightness is influenced by a number of factors. One factor is the load pressure with which the winding roll rests on the support rollers. This rises as the roll diameter increases and thereby increases the winding tightness. Another factor is the tension with which the incoming material web is pulled onto the winding roll. The tension is influenced by the stations preceding the winding device, for example by a cutting device or other devices that can have a braking effect.

Winding tightness may be influenced by driving both support rollers or by means of different circumference speeds or drive moments. The tension in winding the individual layers onto the winding roll may be adjusted. Another method of influencing the winding tightness is by controlled the line load in the nip or roll gap between a support roller and the winding roll. With increasing roll diameter, the weight of the roll clearly increases and with it, the line load, i.e., the pressure with regard to the axial length. If precautions are not taken, this would lead to an increase in the winding tightness from the inside to the outside. However, such a progression is undesirable. Rather, decreasing the winding tightness from the inside to the outside is desirable. One possibility of reducing the line load involves building up pressure in the winding bed, for example in the form of an air cushion, which at least partially supports the winding roll so that the load pressure on the support rollers is reduced. However, in an embodiment of this kind, it must be assured that the winding bed can be sealed. On the one hand, the air losses should be kept low, yet, one must be able to increase the required pressure in the first place.

SUMMARY OF THE INVENTION

The present invention provides a web winding device and method for winding a material web into a winding roll. The device operates to uncouple the web tension that is required for cutting, from the web tension that is required for producing the winding tightness. The device comprises a rotatably driven first support roller having a circumferential shell, with a plurality of shell openings penetrating the shell. A plurality of conduits is axially disposed with the first support roller and axially extends to a stationary end face section. At least one shell opening is in communication with a conduit. A second support roller is also provided, and a winding bed area is defined by the first and second support rollers. A winding bed pressurization device may also be present in the winding bed area, and a seal is fixedly mounted to the end face section and is stationary relative to the rotation of the first support roller. The conduits are sequentially adjacent to the seal (i.e., each conduit is sequentially subjected to the seal) over a portion of the rotation of said first support roller. The seal is present between the first support roller and the stationary end face section.

In the device according to the present invention, the seal may be either a roller pressurization device or a flat seal. The first support roller may also be configured to provide suction at its surface, the suction being present during the winding of the material web.

The shell openings of the device may be in communication with a suction device, the suction device being fixedly relative to the rotation of the first support roller. The suction may also be adjustable in magnitude. Additionally, the magnitude of the suction during winding may be less intense than the magnitude of the suction during the changing of a roll of the material web. Further, the magnitude of the suction during winding may be less intense than the magnitude of the suction during the changing of a roll of the material web.

At the end face of the device, the conduit may be connected to a suction device as a function of rotational position of the first support roller. At least one shell opening is radially connected to be in communication with a conduit, the cross-sectional area of each the conduit being greater that the cross-sectional area of each shell opening.

The outer surface of the suction zone of the first support roller may comprise a plurality of active elements that are both circumferentially and axially arranged and are aligned in relation to one another. Additionally, all active elements may be configured identically. The active elements may further have an elastic surface.

The web winding device may alternatively comprise a suction device fixedly mounted to the end face, the suction device defining a suction zone upstream from the winding bed area with respect to a rotation direction of the first roller, the suction zone transmitting suctional force through the shell openings.

Additionally, the end face of the first support roller may have a seal adjacent to the conduits, whereby each conduit may sequentially come into contact with the seal, the seal being in communication with the winding bed area via the shell openings and preventing the passage of gas through the shell openings communicating with the winding bed area.

The winding bed area may further have a sealing box for sealing the winding bed area. A roller pressurization device is provided adjacent to the conduits whereby each conduit may sequentially come into contact with the roller pressurization device. The roller pressurization device is in communication with the winding bed area via the shell openings and provides pressurized gas in the winding bed area.

The present invention also discloses a method of winding a material web into a winding roll comprising the step of providing suctional force through the shell openings via the conduits in communication with the suction device fixedly mounted to the end face. A further step may include suctionally holding the material web to the circumferential shell at a point which is upstream from the winding bed area with respect to the direction of rotation of the first roller. Additionally, the material web may be threaded onto the winding roll.

The method may also include the steps of sealing the winding bed area and providing pressurized gas to the winding bed area via the shell openings communicating with the winding bed area via the conduit, and/or sealing the shell openings in communication with to the winding bed area via the conduit.

Alternatively, the method of winding a material web into a winding roll may comprise the step of providing pressurized air to the winding bed area through the shell openings via the conduits in communication with the roller pressurization device fixedly mounted to the end face, and may further include the step of sealing the winding bed area.

BRIEF DESCRIPTION OF THE DRAWINGS

The present invention is further described in the detailed description which follows, in reference to the noted plurality of drawings by way of non-limited examples of preferred embodiments of the present invention, in which like numerals represent like elements throughout the several views of the drawings, and wherein:

FIG. 1 shows a front end view of a web winding device according to a first embodiment of the invention;

FIG. 2 is an enlarged front end view of a support roller; and

FIG. 3 is an enlarged side view of the support roller.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The material web described below with respect to the present invention is identified as a paper web for illustrative purposes only. It is readily apparent to those skilled in the art that other material webs can be wound about the invention in alternative embodiments, including but not limited to webs make of cardboard, metal foils, or plastic foils.

The present invention provides a device and method of winding a material web into a winding roll. The device operates to uncouple the web tension that is required for cutting, from the web tension that is required for producing the winding tightness. The winding roll, supported by a first and a second rotating support roller, defines a winding bed area. The first support roller has a circumferential shell and opposed ends. The shell has a plurality of shell openings extending therethrough in communication with a plurality of conduits axially disposed within the circumferential shell. An end face is adjacent to one opposed end of the support roller. The conduits are also in communication with the end face.

The present invention facilitates close contact of the material to the shell of the first roller even when the winding bed area is pressurized. The circumference of the first support roller has a shell with a large number of shell openings in the surface of the shell, which openings communicate with axially extending conduits that reach all the way to at least one end face, wherein the winding bed has a winding bed pressurization device. The end face of the first support roller has a seal adjacent to the conduits that are connected to the winding bed via the shell openings.

The advantages of the compressed air support in the winding bed can be combined with the advantages of the removal of the air layer which would otherwise adhere to the material web through the support roller. Thus, when the material web travels onto the support roller, removing the adhering air layer is possible so that the material web may smoothly contact the support roller. The first support roller is driven, which results in an improved transmission of the drive output to the material web and, therefore, reduces slippage and keeps the loading of the material web low. The shell openings are not routed into the hollow interior of the support roller, but instead communicate with conduits that lead to at least one end face. The displaced air can, therefore, escape outwardly.

Since the support roller has axial conduits, the winding bed may be easily sealed. Only one seal need be provided on the end face of the support roller in the region where the conduits are disposed. The utilization of an end face seal is much simpler than utilizing a sealing device, which has to be accommodated on the interior of the roll.

The seal may function as a roller pressurization device. The conduits whose shell openings communicate with the winding bed can be used to feed pressurized gas into the winding bed. If the support roller rotates further, after leaving the end face seal, the corresponding conduits come back into communication with the surroundings (ambient) so that the pressure can escape before the material web winds on again.

The seal may also function as a flat seal, thereby simplifying construction of the device. Flat seals are desirable, as they produce a high degree of tightness.

The first support roller may be provided with suction in a suction zone present on the surface of the shell, the suction being present during winding of the web. The material web may thus be tightly suctioned against the suction zone during winding of the web. This suctioning enables the material web to be frictionally positioned against the support roller. This frictional connection is gentle and does not result in damage to the material web. The force required for this frictional connection is exerted by the surrounding atmosphere and acts on a relatively large area. Thus, there is no danger of damaging the material web as by compression rolls, belts or the like. By properly configuring the suctional force, slippage of the material web on a support roller may be prevented. Similarly, the tension of the material web can be changed without interfering with cutting parts, by adjusting the second support roller, which is also mechanically driven. The web tension may be interrupted with the aid of the first support roller. After the material web passes the suction zone, the material web is practically tension free. During winding, before the support roller, the cutting part is kept under constant tension. The web tension responsible for the winding tightness can be determined by the pulling force of the second support roller during winding, without slippage of the material web on the first support roller. Thus, there is no interference with the cutting section. Furthermore, air adhering to the material web is aspirated away. In winding devices of the prior art, with smooth papers and high winding speeds, this air has occasionally led to problems because the material web often shifts laterally.

The device of the present invention simplifies the beginning of the winding process. If the beginning of the material web is resting on the support roller and is suctioned tight thereto, then the material web can be easily transported until it reaches the winding bed.

In the winding section, the first support roller has a large number of shell openings in its surface which communicate with a suction device that is fixed against rotation of the roller. During operation, relative movement is produced between the suction device and the support roller. With this relative movement, it is always possible to connect the shell, which are disposed in the relevant suction zone to be in communication with the suction device. The suction zone can thus be kept stationary in absolute terms. The suction zone, however, does not move relative to the rotating surface of the support roller. A seal between the suction device and the support roller is required in order to reduce loss caused by "parasitically" aspirated air. Seals of this kind are known by those skilled in the art. These losses are largely controllable.

The shell openings of the first roller communicate with axially extending conduits that are connected on at least one end face to a suction device as a function of rotational position. The first support roller thus has a series of axially extending conduits or bores disposed within the shell. A suction device is stationarily disposed on at least one end face. When the support roller rotates, all of the axially extending conduits sequentially come into communication with the suction device so that a number of axially extending conduits are always simultaneously connected to the suction device. If these conduits are connected to the surface via shell openings, i.e., especially radially extending bores or other openings, then suction is transmitted until it reaches the suction zone of the support roller, wherein the suction is limited to the suction zone predetermined by the suction device. The necessary suction can be exerted all the way to the surface of the shell of the support roller.

Each conduit may be connected with a number of shell openings in the shell. The surface of the support roller can be provided with relatively evenly distributed openings shell openings without the distance between the conduits becoming too narrow. It is preferable that the cross section of each conduit is greater than the cross section of each shell opening. Only a small amount of air need be transported through the shell openings to produce the desired suction on the surface of the shell of the first support roller. This suction can be easily transported through the large conduit cross sections until reaching the shell openings, i.e., the "inside" of the bores that extend to the surface of the shell. The pressure in the conduits is not affected by the aspiration of small amounts of air. Small leakages cannot be prevented.

The magnitude of the suction may also be adjusted. The suction can be adapted to different qualities of the material webs. For example, for light papers, a less intense suction can be selected. For heavy, cardboard-like papers, more intense suction may be used. Pressure conditions can also be adapted to various operating situations such as winding or roll changing.

It is preferable that the suction during winding be less intense that the suction during a roll change. The beginning of the material web should be secured to the support roller when changing rolls, in order for the material web to be transported to the winding bed. During winding, after the suction zone in which the suction is present, the material web is continuously fed in a way such that the web is wound onto the winding roll so that lower forces are sufficient to produce the necessary frictional connection between the circumference of the support roller and the material web.

The shell of the first support roller contains a number of elements stacked axially and aligned in relation to one another. This embodiment is particularly advantageous if bores or conduits extending in the axial direction are used to distribute the suction and/or pressure. If the support roller is made up of individual elements, then corresponding shell openings can be utilized in the individual elements so that longer bores need not be produced. While, these kinds of bores can be produced, they often result in high manufacturing costs. If individual elements are provided, they are positioned correctly in relation to each other. The corresponding axially extending conduits are then produced automatically. Furthermore, smaller elements may more easily facilitate the mounting of the shell openings to the axially extending conduits.

All of the active elements may be embodied identically. Active elements are those on whose surface the suction can be produced. For example, there can be other end face elements that do not have any shell openings, but only axial conduits, thereby facilitating production, storage and maintenance. For example, if the surface of the roll is damaged in an axial section, then replacing the element at that section is sufficient. Thus, the entire support roller need not be immediately replaced or rebuilt.

Each element may also have an elastic surface. An elastic surface is favorable in support rollers to increase the contact area between the winding roll and the support roller, particularly with greater roll weights. If each element is provided with an elastic surface, then when the elements are assembled, a continuous elastic surface is obtained. Outside the winding bed, the material web is guided over a suction zone of the first support roller. Particularly when high pressure exists in the winding bed to produce an air cushion, this pressurized air, is prevented from being occluded, thereby eliminating problems with very dense papers in which the air cannot escape.

Referring now to the drawings wherein like numerals represent like elements, FIG. 1 shows a web winding device 1 according to the present invention. The device 1 has a cylindrical first support roller 2 and a cylindrical second support roller 3 that define a winding bed 4, each roller rotating on a respective longitudinal axis. Each support roller 2, 3 had a peripheral surface along their respective widths. Each support roller has opposed ends, with an end face 23 present at each respective opposed end (see FIG. 3). The end faces 23 are stationary and do not rotate along with the support rollers 2, 3. A winding roll 5 is supported by the winding bed 4 and is rotated in the direction of arrow 6 in order to wind a material web 7. The first support roller 2 and second support roller 3 are each driven by a respective mechanized drive 8. The respective drives 8 of each support rollers 2, 3 can be controlled independently of each other, for example in order to produce different moments or circumference speeds. Alternatively, the drives 8 can be controlled together.

The peripheral surface of the first support roller 2 forms a cylindrical shell 10 having an elastic surface layer (not shown in detail). The first support roller 2 has a plurality of axially extending conduits 9, which are circumferentially and evenly distributed in the shell, and terminate at an end face 23. The spacing of the conduits 9 from one another and in relation to the shell 10 of the first support roller 2 is of such a size and magnitude that the mechanical properties of the first support roller 2, such as stability, remain unchanged.

Conduits 9 are in communication with shell 10 by virtue of cylindrical shell openings 11 that also pass through an elastic surface layer (not shown in detail) of the first support roller 2. For illustrative purposes, conduits 9 in FIG. 2 are shown larger than in the preferred embodiment. The cross sectional area of each conduit 9 is greater than the cross sectional area of each shell opening 11. Each conduit 9 is connected to be in communication with at least one shell opening 11 and supplies a predetermined surface area of the shell 10 with suction in both the axial and radial directions.

A suction device 12, which is shown in dashed lines in FIGS. 1, 2 and 3, is mounted to an end face 23 of the first support roller 2. Suction device 12 is sealed in relation to the end face 23 of the first support roller 2 and is inside the support roller and is stationary (i.e., does not rotate along with the first support roller). When the first support roller 2 rotates, each conduit 9 sequentially communicates with suction device 12. Thus, a certain number of conduits 9 continuously overlap with suction device 12, which correspondingly produces suction in conduits 9 that overlap the suction device. This suction is transmitted from the suction device 12 though the conduits and then through the shell openings 11 to the shell 10 of the first support roller 2, so that suction is provided in a portion of the surface of the first support roller 2. The angular extension of the suction device 12 is defined by a suction zone, noted by arrow 13 in FIG. 1, over which the material web 7 is suctioned against the first support roller 2. As seen in in FIGS. 1 and 2, this suction zone 13 ends before a contact point or a contact line 14 at which the winding roll 5 rests against the first support roller 2. The suction zone 13 extends approximately 180° along the area of the shell 10 of the support roller not facing the winding bed, and ends in the direction of rotation of the first support roller 2 after the highest point of first support roller 2, i.e., slightly to the left of the highest point of the first support roller in FIGS. 1 and 2.

The suction created by the suction device is so great that the material web 7 is frictionally held onto the surface of the first support roller 2 so that the web is prevented from slipping. Therefore, the first support roller 2 exerts tensional forces on the material web 7 in order to pull the material web 7 until the web reaches the winding device 1.

The suction can also be used to "thread" the material web 7 into the winding device 1 at the beginning of a winding process. The material web 7 need only be brought into contact with the first support roller 2 at the suction zone 13. If the first support roller 2 is then rotated, the suction carries the material web 7 to the end of the suction zone 13. Under the effect of gravity, the material web 7 rests against the first supporter roller 2 and can be pulled forward to a roll core 15, where it is fastened. At the beginning of the winding process, the roll core 15 can be pressed in a manner that is intrinsically known by those skilled in the art (not shown in detail), against the support rollers 2, 3 by means of additional rider rolls in the winding bed. During winding, the material web 7 rests loosely on the first support roller 2 at the moment the web is pulled about the first support roller 2.

In many instances, the suction device is unnecessary. In such a case, the conduits 9 in the suction zone 13 communicates with the ambient surroundings on at least one end face 23. The air layer adhering to the material web 7 is then simply pressed into the shell openings 11 and can then escape to the ambient surroundings via the conduits 9.

The material web 7 is not guided between the two support rollers 2, 3, but is guided outside the winding bed 4. The material web 7 is wound around the first support roller 2 from the outside, i.e., comes into the winding bed 4 from above. This configuration has the advantage that the winding bed 4, i.e., the space between the two support rollers 2, 3 and the winding roll 5, can be acted on with pressure without the danger of air being introduced between the uppermost winding layer of the winding roll 5 and the layers that have already been wound about winding roll 5. Air pressure acts solely on the outside of the uppermost layer of the winding roll 5, i.e. on the outside of the material web 7.

The space between the winding roll 5 and the rollers 2, 3 is sealed from below by a sealing box 16 that longitudinally extends along the length of the shells, thereby preventing gas from escaping from the winding bed. There are sealing devices (not shown in detail) on the ends of the winding bed, that seal the ends of the winding bed, thereby preventing the escape of gas from the winding bed. Additionally, pressure may be provided to the winding bed 4 by a winding bed pressurization device 22.

A seal 17 is provided in the first support roller 2 so that the pressure in the winding bed 4 cannot escape through the shell openings 11 that are facing the winding bed 4. The seal 17 is only required in the region of the inside of the first support roller that faces the winding bed 4. The seal 17 is smooth and flat and rests against the end face 23 of the first support roller 2 or forms a small gap therewith. Thus, pressure losses in the winding bed 4 are kept low.

The conduits 9 and the shell openings 11 can also be used to increase the pressure in the winding bed 4. The seal 17 may be embodied as a roller pressurization device 17 that is likewise only shown by dashed lines in FIGS. 1 and 2, since the roller pressurization device 17 is disposed on the end face 23 of the first support roller 2 on which the suction device 12 can also be disposed. With the aid of the roller pressurization device 17, compressed air can be blown into the conduits 9, from which it travels through the shell openings 11 into the winding bed 4, thereby pressurizing the winding bed.

The seal between the sealing box 16 and the periphery of the support rollers 2, 3 is tight because there need not be any space between the support rollers 2, 3 and the sealing box 16.

All of the shell openings 11 can be closed by values in a manner not shown in detail, wherein the valves are either manually adjusted so that the effective suction surface is limited to the width of the material web 7, or the valves can be actuated by means of the material web 7 itself.

As can be seen from FIG. 3, the first support roller 2 is made up of a plurality of elements 20, 21 that are axially stacked and aligned in relation to one another. There are end face elements 20 that are only used to contain the conduits. A number of active elements 21 are disposed between the end face elements 20, and, as can be seen in FIG. 3, have shell openings 11 having opposed ends, one of the opposed ends communicating with the surface of the first support roller 2, the other of the opposed ends communicating with the conduits 9.

In this embodiment, all of the elements 20, 21 have an elastic surface 19. The elastic surface 19 of the active elements 21 is penetrated by the shell openings 11.

If the suction device 12 or the roller pressurization device 17 is provided on the end faces 23 of the first support roller 2, sealing can be executed relatively simply. The end faces 23 of the first support roller 2 can be embodied as flat surfaces so that only a flat seal is required.

The suction device can also be embodied as it is represented in EP 0 791 550 A2, the disclosure of which is expressly incorporated by reference herein in its entirety. The material web can also be supplied to the winding bed between the support rollers, if the material web is air permeable.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A web winding device for winding a material web into a winding roll, the device comprising:

a rotatably driven first support roller having a circumferential shell and an end face on an axial end of said circumferential shell, said shell having a plurality of shell openings extending therethrough;

a plurality of conduits axially disposed within and rotating with said first support roller and axially extending to said end face, said shell openings communicating with said conduit;

a second support roller;

a winding bed area defined by said first and said second support rollers;

a winding bed pressurization device configured to provide pressure in said winding bed area; and a seal stationarily and fixedly mounted to seal said end face, said conduits in communication with said seal at a portion of the rotation of said first support roller.

2. The web winding device according to claim 1 wherein said seal is a roller pressurization device.

3. The web winding device according to claim 1 wherein said seal is a flat seal.

4. The web winding device according to claim 1, wherein said first support roller is adapted to provide suction at the surface of said first support roller, the suction being present during the winding of the material web.

5. The web winding device according to claim 4, wherein said shell openings are in communication with a suction device, said suction device being fixed relative to the rotation of said first support roller.

6. The web winding device according to claim 4, further comprising a suction adjustment device configured to adjust the suction magnitude.

7. The web winding device according to claim 6, wherein said suction adjustment device is adapted to provide suction of less intense magnitude than the magnitude of the suction during the changing of a roll of the material web.

8. The web winding device according to claim 4, wherein said pressure and said suction are provided at said end face at the same axial end of said circumferential shell.

9. A web winding device for winding a material web into a winding roll, the device comprising:

a rotatably driven first support roller having a circumferential shell and an end face on an axial end of said circumferential shell, said shell having a plurality of shell openings extending therethrough;

a plurality of conduits axially disposed within said first support roller and axially extending to said end face, said shell openings communicating with said conduit whereupon at said end face, said plurality of conduits is adapted to be in sequential communication with a suction device over a portion of the rotation of said first support roller;

a second support roller;

a winding bed area defined by said first and said second support rollers;

a winding bed pressurization device configured to provide pressure in said winding bed area; and a seal stationary and fixedly mounted to seal said end face, said conduits in communication with said seal at a portion of the rotation of said first support roller.

10. The web winding device according to claim 1, wherein a plurality of said openings are radially connected in communication with a said conduit.

11. The web winding device according to claim 1, wherein a cross-sectional area of each of said conduits is greater than a cross-sectional area of each corresponding said shell opening.

12. The web winding device according claim 1, wherein said shell of said first support roller comprises a plurality of active elements that are evenly spaced about said shell.

13. The web winding device according to claim 12, wherein all said active elements are configured identically.

14. The web winding device according to claim 12, wherein each said active element has an elastic surface.

15. The web winding device according to claim 1, the web winding device being adapted to guide the material web over a suction zone of said first support roller at a position outside said winding bed area.

16. A web winding device for winding a material web into a winding roll, the device comprising:

a rotatably driven first support roller having a circumferential shell and opposed ends, said shell having a plurality of shell openings extending therethrough;

an end face disposed at one of said opposed ends of said first support roller;

a plurality of conduits axially disposed within said first support roller and axially extending to said end face;

a second support roller;

a winding bed area defined by said first and said second support roller, and adapted to support the winding roll; and a suction device fixedly mounted to said end face, said suction device defining a suction zone upstream from said winding bed area with respect to the direction of rotation of said first roller, said plurality of conduits adapted to be in sequential communication with said suction device over a portion of the rotation of said first support roller, said suction zone being further adapted to provide suctional force through said conduits in sequential communication with said suction device over a portion of the rotation of said first support roller;

wherein said end face of said first support roller has a seal adjacent to said conduits, said conduits being sequentially adjacent to said seal over a portion of the rotation of said first support roller, said seal preventing the passage of gas through said shell openings in communication with said winding bed area.

17. The web winding device according to claim 16, said winding bed area further having a sealing box for sealing said winding bed area.

18. The web winding device according to claim 17, further comprising a roller pressurization device adjacent to said plurality of conduits, said plurality of conduits being sequentially in communication with said roller pressurization device over a portion of the rotation of said first support roller.

19. The web winding device according to claim 18, wherein said suction device and said roller pressurization device are both located on the same end face of said first support roller.

20. A web winding device for winding a material web into a winding roll, the device comprising:

a rotatably driven first support roller having a circumferential shell and opposed ends, said shell having an outer surface, an inner surface and further having a plurality of shell openings therethrough;

a end face disposed at one of said opposed ends of said first support roller;

a plurality of conduits axially disposed within said first support roller and axially extending to said end face, at least one of said plurality of shell openings communicating with each said conduit;

a second support roller;

a winding bed area defined by said first and said second support roller, and adapted to support the winding roll, said winding bed area further having a sealing box for sealing said winding bed area; and a roller pressurization device in communication with said end face, said conduits being in sequential communication with said roller pressurization device, said roller pressurization device being adapted to pressurize said winding bed area by providing pressurized gas to said conduits at a portion of the rotation of said first support roller.

21. A method of winding a material web into a winding roll, the winding roll being supported by a first and a second rotating support roller defining a winding bed area, the first support roller having a circumferential shell and opposed ends, the shell having a plurality of shell openings extending therethrough and being in communication with a plurality of conduits axially disposed within the circumferential shell, an end face adjacent to one opposed end of the support roller, the conduits in communication with the end face, a suction device fixedly mounted to a portion the end face at a portion of the rotation of the first support roller, said method comprising:

rotating the conduits such that the conduits sequentially communicate with the suction device, over a portion of the rotation of the first support roller;

providing suctional force through the conduits in communication with the suction device;

sealing the winding bed area;

sequentially moving the conduits in communication with a roller pressurization device, over a portion of the rotation of the first support roller; and pressurizing the winding bed area by providing pressurized gas through the conduits in communication with the roller pressurization device.

22. The method of winding a material web into a winding roll according to claim 21, further comprising suctionally holding the material web to the circumferential shell at a point which is upstream from the winding bed area with respect to a rotation direction of the first roller.

23. The method of winding a material web into a winding roll according to claim 22, further comprising threading the material web onto the winding roll.

24. The method of winding a material web into a winding roll according to claim 21, wherein said providing suctional force and said pressurizing are both provided at the same end of the first support roller.

25. A method of winding a material web into a winding roll, the winding roll being supported by a first and a second rotating support roller defining a winding bed area, the first support roller having a circumferential shell and opposed ends, the shell having a plurality of shell openings extending therethrough and being in communication with a plurality of conduits axially disposed within the circumferential shell, an end face adjacent to one opposed end of the support roller, the conduits in communication with the end face, a suction device fixedly mounted to a portion the end face at a portion of the rotation of the first support roller, said method comprising:

rotating the conduits such that the conduits sequentially communicate with the suction device, over a portion of the rotation of the first support roller;

providing suctional force through the conduits in communication with the suction device;

sealing the winding bed area;

sequentially moving the conduits in communication with a flat seal, over a portion of the rotation of the first support roller; and sealing the shell openings in communication with the conduits in communication with the flat seal.

26. The method of winding a material web into a winding roll according to claim 25, wherein said providing suctional force and said pressurizing are both provided at the same end of the first support roller.

27. A method of winding a material web into a winding roll, the winding roll being supported by a first and a second rotating support roller defining a winding bed area, the first support roller having a circumferential shell and opposed ends, the shell having a plurality of shell openings extending therethrough and being in communication with a plurality of conduits axially disposed within the circumferential shell, an end face adjacent to one opposed end of the support roller, the conduits being in communication with the end face, a roller pressurization device fixedly mounted to the end face, said method comprising:

rotating the conduits such that the conduits sequentially communicate with the suction device, over a portion of the rotation of the first support roller; and pressurizing the winding bed area by providing pressurized gas through the conduits in communication with the roller pressurization device.

28. The method of winding a material web into a winding roll according to claim 27, further comprising sealing the winding bed area.

* * * * *